US008830022B2

(12) United States Patent
Inaba et al.

(10) Patent No.: US 8,830,022 B2
(45) Date of Patent: Sep. 9, 2014

(54) REACTOR AND METHOD FOR MANUFACTURING REACTOR

(75) Inventors: Kazuhiro Inaba, Osaka (JP); Miki Kitajima, Osaka (JP); Shinichiro Yamamoto, Osaka (JP); Hajime Kawaguchi, Osaka (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 0 days.

(21) Appl. No.: 13/579,844

(22) PCT Filed: Dec. 8, 2010

(86) PCT No.: PCT/JP2010/071958
§ 371 (c)(1),
(2), (4) Date: Aug. 17, 2012

(87) PCT Pub. No.: WO2011/104975
PCT Pub. Date: Sep. 1, 2011

(65) Prior Publication Data

US 2012/0313740 A1 Dec. 13, 2012

(30) Foreign Application Priority Data

Feb. 25, 2010 (JP) ..... 2010-039831
Dec. 2, 2010 (JP) ..... 2010-269530

(51) Int. Cl.
*H01F 27/24* (2006.01)
*H01F 27/02* (2006.01)
*H01F 37/00* (2006.01)
*H01F 27/255* (2006.01)

(52) U.S. Cl.
CPC ..... *H01F 37/00* (2013.01); *H01F 27/255* (2013.01); *H01F 27/022* (2013.01)
USPC ..... 336/233; 336/61; 336/83; 336/92

(58) Field of Classification Search
USPC ..... 336/55–61, 212, 221, 233, 90, 92, 83
See application file for complete search history.

(56) References Cited

U.S. PATENT DOCUMENTS 6,980,077 B1 * 12/2005 Chandrasekaran et al. .. 336/212
7,427,909 B2 * 9/2008 Ono et al. ..... 336/90

(Continued)

FOREIGN PATENT DOCUMENTS

CN 1210345 A 3/1999
JP 04-373107 12/1992

(Continued)

OTHER PUBLICATIONS

Office Action in Chinese Patent Application No. 201080064835.3, dated Dec. 4, 2013.

(Continued)

*Primary Examiner* — Alexander Talpalatski
*Assistant Examiner* — Mangtin Lian
(74) *Attorney, Agent, or Firm* — Venable LLP; Michael A. Sartori; Tamatane J. Aga

(57) ABSTRACT

Provided is a reactor including a core; and a case housing the coil and the core, the core including an inner core portion arranged inside the coil and an outer core portion partly or entirely covering the outside of the coil, the outer core portion being formed of a mixture of a magnetic material and a resin. The coil is arranged such that the axial direction of the coil is substantially parallel to a bottom surface of the case. The difference in concentration of the magnetic material in the outer core portion in the axial direction of the coil is smaller than the difference in concentration of the magnetic material in the outer core portion in a direction along a side wall of the case. With the reactor, even if the outer core portion covering the outside of the coil is formed of the mixture of the magnetic material and the resin, a desirable inductance value can be easily achieved and the reactor can have good heat radiation performance.

8 Claims, 10 Drawing Sheets

(56) References Cited

U.S. PATENT DOCUMENTS

| | | | | |
|---|---|---|---|---|
| 2009/0144967 | A1* | 6/2009 | Hasu et al. | 29/605 |
| 2010/0026434 | A1* | 2/2010 | Okamoto et al. | 336/65 |

FOREIGN PATENT DOCUMENTS

| | | | |
|---|---|---|---|
| JP | 11-067519 | | 3/1999 |
| JP | 2006-004957 | | 1/2006 |
| JP | 2007-335833 | A | 12/2007 |
| JP | 2008-112856 | A | 5/2008 |
| JP | 2008-187119 | | 8/2008 |
| JP | 2008-210820 | | 9/2008 |
| JP | 2009-004670 | A | 1/2009 |
| JP | 2009-033051 | A | 2/2009 |
| JP | 2010-003838 | | 1/2010 |
| JP | 2010-118610 | | 5/2010 |
| JP | 2010-263088 | | 11/2010 |
| JP | 2012-004292 | A | 1/2012 |
| JP | 2012-019087 | A | 1/2012 |
| WO | WO-2009/125593 | A1 | 10/2009 |
| WO | WO-2011/027559 | A1 | 3/2011 |
| WO | WO-2011/089941 | A1 | 7/2011 |

OTHER PUBLICATIONS

Notification of Reasons for Rejection in Japanese Patent Application No. 2011-059977, dated Jul. 15, 2014.

* cited by examiner

REACTOR AND METHOD FOR MANUFACTURING REACTOR

TECHNICAL FIELD

The present invention relates to a reactor used for a component of a power converter such as a vehicle-mounted direct current-direct current (DC-DC) converter.

BACKGROUND ART

A hybrid electric vehicle, a plug-in hybrid electric vehicle, an electric vehicle, and the like, each need a converter that performs a step-up operation and a step-down operation when a travel motor is driven or a battery is charged. Even for a fuel cell vehicle, the output of a fuel cell is stepped up. One of parts of the converter is a reactor. For example, a reactor has a form in which a pair of coils each having an O-shaped magnetic core and a wire wound on the outer periphery of the magnetic core are arranged in parallel.

PTL 1 discloses a reactor including a magnetic core having an E-shaped cross section, the magnetic core which is so-called a pot core. The magnetic core includes a columnar inner core portion inserted into a single coil, a cylindrical outer core portion arranged to cover the outer periphery of the coil, and a pair of disk-like coupling core portions arranged at both end surfaces of the coil. In the pot core, the coupling core portions couple the concentrically arranged inner and outer core portions with each other and hence a closed magnetic circuit is formed. PTL 1 also discloses that a small reactor can be obtained by increasing the saturation magnetic flux density of the inner core portion as compared with those of the outer core portion and the coupling core portions and hence decreasing the cross-section area of the inner core portion.

CITATION LIST

Patent Literature

PTL 1: Japanese Unexamined Patent Application Publication No. 2009-033051

SUMMARY OF INVENTION

Technical Problem

A part the installation space of which is narrow, such as a vehicle-mounted part, is desirably small. PTL 1 discloses the magnetic core in which a plurality of divided pieces are bonded with an adhesive and integrated. However, regarding a further decrease in size, even the adhesive is desirably omitted. PTL 1 discloses a configuration without necessity of an adhesive because the entire magnetic core is a powder compact and the magnetic core is molded by arranging the coil in a mold together with a powder material. However, if the magnetic core in which the saturation magnetic flux density partly varies is formed of the powder compact, a pressing step has to be performed by multiple steps depending on the shape of the magnetic core. This may cause a decrease in productivity.

The applicant and others suggest that the outside of a coil is covered with an exposure core portion that is formed of a mixture of a magnetic material and a resin, in order to provide a reactor that is small and has good productivity. If the magnetic core is formed of the mixture of the magnetic material and the resin in this way, the concentration of the mixture may vary when the magnetic material is hardened. It may be difficult to achieve an inductance of a designed value.

To address such a problem, the present invention provides a reactor that can easily achieve a desirable inductance value and has good heat-radiation performance even if an outer core portion covering the outside of a coil is formed of a mixture of a magnetic material and a resin.

Solution to Problem

A reactor provided by the present invention includes a coil; a core; and a case housing the coil and the core, the core including an inner core portion arranged inside the coil and an outer core portion partly or entirely covering the outside of the coil, the outer core portion being formed of a mixture of a magnetic material and a resin. The coil is arranged such that the axial direction of the coil is substantially parallel to a bottom surface of the case. The difference in concentration of the magnetic material in the outer core portion in the axial direction of the coil is smaller than the difference in concentration of the magnetic material in the outer core portion in a direction along a side wall of the case.

With this reactor, the coil is arranged such that the axial direction of the coil is substantially parallel to the bottom surface of the case, and the difference in concentration of the magnetic material in the outer core portion in the axial direction of the coil is smaller than the difference in concentration of the magnetic material in the outer core portion in the direction along the side wall of the case. Accordingly, the difference in concentration of the magnetic material in a magnetic flux direction becomes small. The magnetic material is distributed more at the bottom-surface side of the case, and a magnetic circuit is formed in that area in a concentrated manner. However, an inductance of a designed value is easily achieved for the entire reactor.

In addition, since the coil is arranged such that the axial direction of the coil is substantially parallel to the bottom surface of the case and an end surface of the coil faces the side wall of the case, the outer peripheral surface of the coil faces the bottom surface of the case. Hence, heat is more likely radiated from the bottom surface of the case as compared with a case in which the coil is arranged such that the end surface of the coil faces the bottom surface of the case.

It is to be noted that the concentration of the magnetic material is an amount expressing the dispersed density of the magnetic material dispersed in the mixture of the magnetic material and the resin (not the density of the magnetic material, but the ratio of the magnetic material to the mixture). The concentration of the magnetic material is representatively expressed by the density of the mixture. Otherwise, the concentration of the magnetic material may be expressed by the volume ratio of the magnetic material to the resin, or the area ratio of the magnetic material in a cross section. Also, the bottom surface of the case is a surface at the lower side when the mixture of the magnetic material and the resin is filled and hardened, in a direction corresponding to the bottom of the case, and the side wall is a surface that is vertically arranged on the bottom surface in a substantially perpendicular direction.

When the concentration of the magnetic material at a bottom-surface side is compared with the concentration of the magnetic material at an upper-surface side opposite to the bottom surface in the direction along the side wall, the difference in concentration of the magnetic material in the outer core portion may be preferably larger than 0% and equal to or smaller than 45% with reference to the concentration at the bottom-surface side. Since the concentration at the bottom-surface side is high and the concentration at the upper-surface side is low, heat generated inside is concentrated at the bottom-surface side and hence heat-radiation efficiency increases. To increase heat-radiation performance, the difference in concentration may be preferably 3% or larger, and more preferably 5% or larger in the point of view for obtaining an effective advantage for heat radiation. Meanwhile, when the difference between the weight of the magnetic material such as iron powder and the weight of the resin material is considered, the difference in concentration may be about 75% at maximum. However, if the difference in concentration is 45% or larger, the contribution of the outer core as a substantial magnetic substance at the upper-surface side with a low concentration becomes too small, and the size of the outer core may be too large to obtain a desirable inductance as the entire reactor. In these points of view, the difference in concentration may be preferably in a range from 3% to 45%, more preferably in a range from 5% to 20%, and further preferably in a range from 10% to 20%.

When the difference in concentration of the magnetic material in the outer core portion is determined with reference to the maximum value of the concentration in one direction, if the difference in concentration is 3% or larger in the direction along the side wall of the case and if the coil is arranged such that the axial direction of the coil is parallel to the direction along the side wall of the case, the difference in concentration in the magnetic flux direction becomes 3% or larger, and it may be difficult to achieve a desirable inductance value. In other words, by arranging the coil such that the axial direction of the coil is substantially parallel to the bottom surface of the case, the difference in concentration in the magnetic flux direction is easily suppressed, and a desirable inductance value can be obtained.

If the bottom surface of the case is configured to be forcedly cooled, the heat-radiation efficiency can be effectively increased. Forced cooling represents various means for effectively radiating heat by using, for example, a water-cooling mechanism or a heat radiation fin, as compared with natural air cooling of the case. If a structure capable of performing forced cooling is provided at the bottom surface of the case, or if a structure for thermal connection with an additionally arranged forcedly cooling mechanism (a mount structure or a mount surface) is provided, the effect caused by the difference in concentration of the magnetic material can be attained.

If the inner core portion has a higher saturation magnetic flux density than a saturation magnetic flux density of the outer core portion, the size of the entire reactor for obtaining the desirable inductance can be decreased. Owing to this, the inner core portion may be preferably made of a powder compact. In this case, since a powder core has a high heat density, it is effective to provide a difference in concentration for the mixture of the magnetic material and the resin forming the outer core and to increase the cooling efficiency to the bottom-surface side. In this meaning, the bottom surface can be expressed as a cooling surface that is forcedly cooled.

In this reactor, the case may have an inner wall surface formed to correspond to an external shape of at least one of the coil and the inner core portion. In this case, the area of the inner wall surface facing the outer surface of the coil can be increased, and as the result, the heat-radiation performance can be further increased.

According to an aspect of the reactor, an outer peripheral surface of the coil is partly exposed from the outer core portion. Since the coil is arranged such that the end surface of the coil faces the side wall of the case, even if the outer peripheral surface of the coil is partly exposed, the other part of the outer core portion is continued in the axial direction of the coil, and hence the magnetic circuit can be ensured. The magnetic circuit is formed at the bottom-surface side of the case in a concentrated manner. Hence, for example, if the outer peripheral surface of the coil is exposed at the upper side of the case, the influence on the inductance value is particularly small. Accordingly, the heat-radiation performance can be increased by partly exposing the outer peripheral surface of the coil while a desirable inductance value is achieved. It is to be noted that if the outer peripheral surface of the coil is exposed at the upper side of the case, a lid made of a conductive material such as metal is preferably provided because a magnetic flux may leak to an air layer.

In the reactor, the case may have a support portion that supports the coil and the inner core portion by supporting both end portions of the inner core portion protruding from the coil. With the support portion, the coil can be easily positioned in the case, and the reactor that achieves a desirable inductance value can be further easily manufactured. Further, the support portion can ensure insulation between the case and the coil. In addition, the support portion allows the inner core portion to be structurally continued to the bottom surface of the case. Heat is easily radiated from the inner core portion to the bottom surface of the case.

Also, the present invention provides a method for manufacturing a reactor, including a housing step of preparing a coil assembly including a coil and an inner core inserted into the coil, and a case having a bottom surface and a side wall, and housing the coil assembly in the case such that the bottom surface of the case is substantially parallel to the axial direction of the coil; a filling step of filling the case with a mixture containing a magnetic material and a resin; and a hardening step of hardening the filled mixture after the filling step. The hardening step holds at least three heating temperatures for predetermined periods of time. One of the three heating temperatures is a temperature at which viscosity becomes substantially the minimum and thus the mixture is not substantially hardened. Accordingly, a reactor having a desirable difference in concentration can be obtained.

Advantageous Effects of Invention

With the present invention, as described above, the reactor that can easily achieve a desirable inductance value and has good heat-radiation performance even if the outer core portion covering the outside of the coil is formed of the mixture of the magnetic material and the resin can be obtained.

BRIEF DESCRIPTION OF DRAWINGS

The above-described object and other objects, features, and advantages are described according to the following embodiment provided below with reference to the accompanying figures. In the figures, the same reference sign represents the same part even in different figures.

DESCRIPTION OF EMBODIMENT

Figure 1:
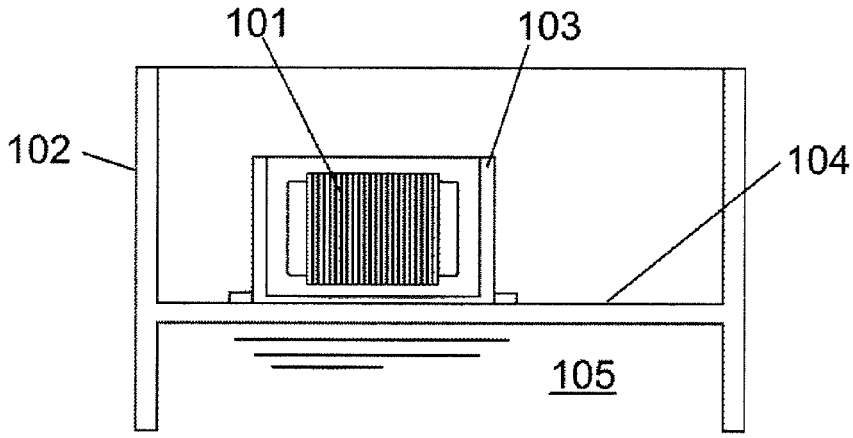
FIG. 1 is an illustration showing an installation state of a reactor according to an embodiment of the present invention.

The present invention is described in more detail below. FIG. 1 is an illustration showing an installation state of a reactor according to an embodiment of the present invention. A reactor 101 according to the embodiment can be used for a part of a vehicle-mounted DC-DC converter. The reactor 101 is housed in a converter case 102 made of aluminum together with other parts. In this embodiment, the reactor 101 includes a case 103 made of aluminum and having, for example, a box-lid-like shape. The reactor 101 is arranged in the converter case 102 such that the case 103 is fixed to an inner bottom surface 104 of the converter case 102 by a bolt. A bottom surface of the case 103 is in surface-contact with the inner bottom surface 104 of the converter case 102.

In the vehicle-mounted converter, current with 100 amperes or more at maximum may be applied to the reactor 101, resulting in that the reactor 101 generates heat at high temperatures. In order to cool the reactor 101 and other parts, cooling water 105 is being introduced to an outer bottom surface of the converter case 102. The heat generated by the reactor 101 is transferred to the converter case 102 through the bottom surface of the case 103 and is dissipated by the cooling water 105.

Figure 2A:
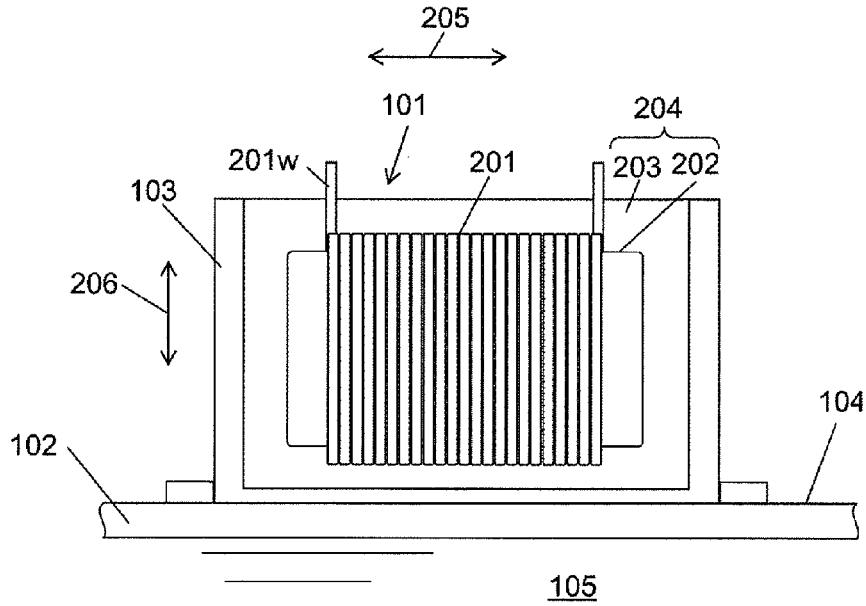
FIG. 2A is a front view showing the brief configuration of the reactor according to the embodiment.
Figure 2B:
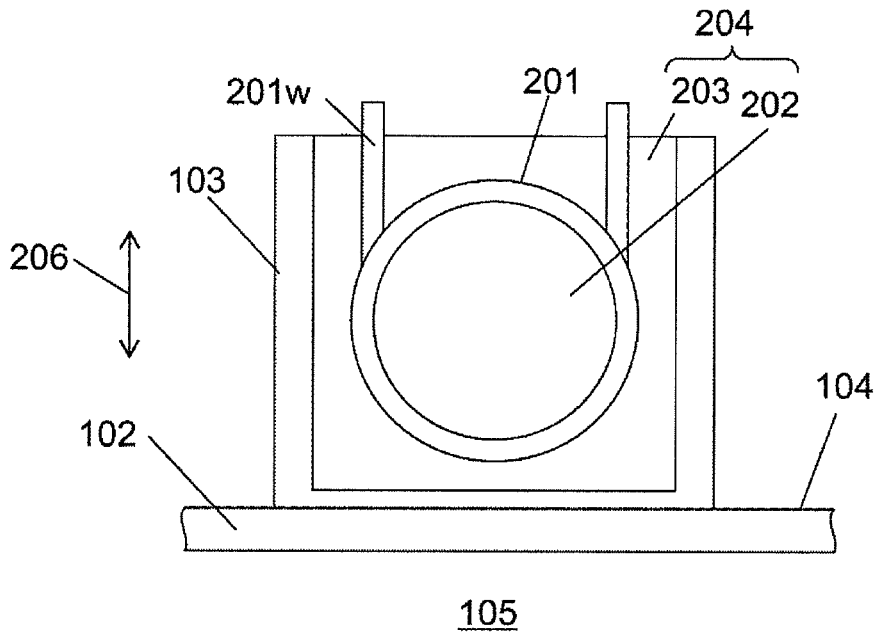
FIG. 2B is a side view showing the brief configuration of the reactor according to the embodiment.

FIGS. 2A and 2B are a front view and a side view showing the brief configuration of the reactor according to the embodiment. The reactor 101 includes a coil 201 and a core 204. The core 204 includes an inner core portion 202 arranged inside the coil 201, and an outer core portion 203 covering the outside of the coil 201. The case 103 included in the reactor 101 houses the coil 201 and the core 204.

In this reactor 101, the coil 201 is formed by winding a single continuous wire 201*w* in a spiral form, and has the axial direction 205 arranged substantially in parallel to the bottom surface of the case 103. Both ends of the wire 201*w* are connected with a semiconductor element of the converter and a battery. The wire 201*w* preferably uses a coated wire having an insulating coating made of an insulating material on the outer periphery of a conductor made of a conducting material, such as copper or aluminum. The wire 201*w* uses a coated rectangular wire, in which the conductor is formed of a rectangular wire made of copper and the insulating coating is made of enamel. The cross section of the conductor of the wire 201*w* may not be the rectangular cross section, and may be any of various cross sections, such as a circular cross section, and a polygonal cross section.

The reactor having the above-described configuration can be preferably used for a particular purpose of use under electricity application conditions in which a maximum current (direct current) is in a range from about 100 to 1000 A, an average voltage is in a range from about 100 to 1000 V, and a usable frequency is in a range from about 5 to 100 kHz, or typically, a component of a vehicle-mounted power converter in a vehicle such as an electric vehicle, a hybrid electric vehicle, etc. With the particular purpose of use, it is expected that a configuration that satisfies conditions in which an inductance when applied direct current is 0 A is in a range from 10 μH to 2 mH and an inductance when applied current is a maximum application current is 10% or more of the inductance when applied current is 0 A can be preferably used. When the reactor is a vehicle-mounted part, the reactor containing the case preferably has a capacity in a range from about 0.2 litters (200 $cm^3$) to about 0.8 litters (800 $cm^3$). In this example, the capacity is about 0.4 litters.

The coil 201 forms a single coil element. Alternatively, a single wire may form a plurality of coil elements and these coil elements may be housed in a case. The plurality of coil elements do not have to be formed of a single wire, and may be formed of separate wires. The wires may form an integrated coil by bonding ends of the wires by welding or the like. For welding the separate wires, for example, tungsten inert gas (TIG) welding, laser welding, or resistance welding may be used. Alternatively, the ends of the wires may be bonded by contact bonding, cold pressure welding, or vibration welding.

Both end portions of the wire 201*w* forming the coil 201 are led from turns by a certain amount to the outside of the outer core portion 203. The insulating coating of both end portions is removed and the conductor portions are exposed. Terminal members made of a conductive material such as copper or aluminum are connected with the exposed conductor portions. The coil 201 is connected with a battery etc. through the terminal members. The connection between both end portions of the wire 201*w* and the terminal members can use welding such as TIG welding or contact bonding etc.

The core 204 forms a closed magnetic circuit because the inner core portion 202 and the outer core portion 203 are integrated. In this embodiment, the inner core portion 202 and the outer core portion 203 are formed of different forming materials, and hence have different magnetic properties. To be more specific, the inner core portion 202 has a higher saturation magnetic flux density than that of the outer core portion 203, and the outer core portion 203 has a lower permeability than that of the inner core portion 202.

The inner core portion 202 has an external shape extending along the shape of the inner peripheral surface of the coil 201 (if a plurality of coil elements are formed, each coil element). In this case, the inner core portion 202 has a columnar external shape. Alternatively, the inner core portion 202 may have an external shape like a rectangular-parallelepiped with an end-surface shape being a rectangular with rounded corners (a track-like shape), or other external shape. The inner core portion 202 may be entirely formed of a powder compact, and may have a configuration in which a gap member, an air gap, or a bonding member is not interposed. However, the inner core portion is not limited to the above-described configuration. A powder compact may be divided into a plurality of cores and the cores may be coupled with each other with an adhesive. In this case, even if the adhesive is interposed, the adhesive does not substantially function as a gap. Also, a gap member may be included if required in view of design to obtain a desirable performance.

The powder compact is typically obtained by molding a soft magnetic powder having an insulating coating on the surface thereof, and burning the soft magnetic powder at a heat-resistant temperature or lower of the insulating coating. A mixed powder in which a binder is appropriately mixed to the soft magnetic powder may be used, or a powder having a coating made of silicone resin as the insulating coating may be used. The saturation magnetic flux density of the powder compact can be changed depending on the material of the soft magnetic powder, and by adjusting the mixing ratio of the soft magnetic powder and the binder, and the amount of any of various coatings. For example, by using a soft magnetic powder with a high saturation magnetic flux density or by decreasing the contained amount of the binder and increasing the ratio of the soft magnetic material, a powder compact with a high saturation magnetic flux density is obtained. Alternatively, the saturation magnetic flux density tends to be increased even by changing a molding pressure, more particularly, by increasing the molding pressure. The soft magnetic powder may be selected and the molding pressure may be adjusted to obtain a desirable saturation magnetic flux density.

The soft magnetic powder may be an iron-family metal powder, such as iron (Fe), cobalt (Co), or nickel (Ni); a Fe base alloy powder, such as Fe-silicon (Si), Fe—Ni, Fe-aluminum (Al), Fe-chromium (Cr), Fe—Cr, Fe—Si—Al; or alternatively, a rare earth metal powder or a ferrite powder. In particular, the Fe base metal powder likely provides a powder compact with a high saturation magnetic flux density. Such a powder can be produced by atomizing (gas or water), mechanical pulverizing, or other method. If a powder formed of a nanocrystal material having a nanosized crystal, or more preferably, a powder formed of an anisotropic nanocrystal material is used, a powder compact which is highly anisotropic and has a small coercive force is obtained. The insulating coating formed on the soft magnetic powder uses, for example, a phosphate compound, a silicon compound, a zirconium compound, or a boron compound. The binder may use a thermoplastic resin, a non-thermoplastic resin, or a higher fatty acid. The binder is lost or changed to an insulator such as silica by burning. Since the powder compact has an insulator such as the insulating coating, the soft magnetic powder is insulated from other soft magnetic powder, and hence an eddy current loss can be reduced. Even if power with a high frequency is applied to the coil, the loss can be reduced.

The inner core portion 202 contains a configuration that is entirely arranged inside the coil (element), and also a configuration that partly protrudes from the coil (element). In an example shown in FIGS. 2A and 2B, the inner core portion 202 has a larger length in the axial direction of the coil 201 than the length of the coil 201. Both end portions of the inner core portion 202 protrude from end surfaces of the coil 201. The length of the inner core portion 202 may be equivalent to or slightly smaller than the length of the coil 201. If the length of the inner core portion 202 is equivalent to or larger than the length of the coil 201, the magnetic flux generated by the coil 201 can sufficiently pass through the inner core portion 202.

In this embodiment, the outer core portion 203 is formed to cover substantially entirely the coil 201 and the inner core portion 202. In other words, the outer core portion 203 substantially covers the entire outer periphery of the coil 201, both end surfaces of the coil 201, and both end surfaces of the inner core portion 202. The inner core portion 202 and the outer core portion 203 are bonded together by a forming resin of the outer core portion 203 without an adhesive member interposed therebetween. By such bonding, the core 204 can be entirely integrated without a gap.

The outer core portion 203 has an external shape of a rectangular-parallelepiped corresponding to the inner wall surface of the case as a basic external shape. However, the shape of the outer core portion 203 is not particularly limited as long as a closed magnetic circuit can be formed. The outer side of the coil 201 may not be partly covered with the outer core portion 203 and hence may be exposed.

The outer core portion 203 can be entirely formed of a mixture (hardened compact) of a magnetic material and a resin. The hardened compact can be typically formed by injection molding or cast molding. The injection molding normally mixes a soft magnetic powder (or a mixed powder to which a non-magnetic powder is further added if required) and a binder resin having fluidity, injects the mixed fluid into a mold (in this example, the case 103) and molds the mixed fluid with a predetermined pressure, and then hardens the binder resin. The cast molding obtains the mixed fluid like the injection molding, and then injects the mixed fluid into a mold (the case 103) to mold and harden the mixed fluid without application of a pressure. In either of the molding methods, the binder resin can preferably use a thermosetting resin, such as epoxy resin, phenol resin, or silicone resin. If the binder resin uses the thermosetting resin, the compact is heated and hence the resin is thermally hardened. The binder resin may alternatively use a room-temperature-setting resin or a low-temperature-setting resin. In this case, the resin is left at a temperature in a range from a room temperature to a relatively low temperature to harden the resin. The binder resin, which is a non-magnetic material, remains in the hardened compact by a large amount. Hence even if the hardened compact uses the same soft magnetic powder as that of the powder compact, the hardened compact has a lower saturation magnetic flux density and a lower permeability than those of the powder compact.

The soft magnetic powder for the outer core portion 203 can use a powder equivalent to the soft magnetic powder for the above-described inner core portion 202.

An insulator is preferably arranged at a position at which the core 204 is in contact with the coil 201 in order to further increase insulation between both the parts. For example, an insulating tape may be attached to the inner and outer peripheral surfaces of the coil 201, or insulating paper or an insulating sheet may be arranged. A bobbin made of an insulating material may be arranged on the outer periphery of the inner core portion 202. The forming material of the bobbin can preferably use an insulating resin, such as polyphenylene sulfide (PPS) resin, liquid crystal polymer (LCP), or polytetrafluoroethylene (PTFE) resin.

A typical density of a mixture of a magnetic material and a resin used in the present invention is in a range from about 3.0 to 5.5 g/cm$^3$. In particular, if the resin material is epoxy resin and the magnetic material is Fe, the density is in a range from about 3.5 to 4.7 g/cm$^3$. If the magnetic material is Fe-6.5Si (Fe base metal containing Si by 6.5% by weight), the density is in a range from 3.6 to 5.0 g/cm$^3$. If the magnetic material is Sendust (Fe—Al—Si alloy), the density is in a range from about 3.6 to 5.0 g/cm$^3$. Also, if the inner core portion is a powder compact made of Fe powder to have typical dimensions, the density may be in a range from 6.5 to 7.8 cm$^3$. The dimensions include a diameter in a range from 10 to 70 mm and a height in a range from 20 to 120 mm when a core cross-section is a circle. The coil may have an inner diameter in a range from 20 to 80 mm and the number of turns of the coil may be in a range from 30 to 70 when a coil cross-section is a circle. If the outer core has an external shape of a rectangular-parallelepiped, the shape may have a side in a range from about 60 to 100 mm, and if the case has a shape of a rectangular-parallelepiped, the shape may have a side in a range from about 60 to 100 mm.

The above-described reactor may be manufactured, for example, by steps in order from a housing step, a filling step, and a hardening step described later. The steps will be described below.

In the housing step, the coil 201 is housed in the case 103. If the inner core portion 202 is formed of a material different from the material of the outer core portion, such as when the inner core portion 202 is made of the powder compact like this example, or is alternatively made of electromagnetic steel sheet, the coil 201 and the inner core portion 202 are prepared, the inner core portion 202 is inserted into the coil 201, and hence an assembly of the coil 201 and the inner core portion 202 is fabricated. This assembly may be fabricated at any timing as long as the timing is before the next filling step. Also, an insulator may be appropriately arranged between the coil 201 and the inner core portion 202 as described above. Then, the assembly is housed in the case 103. When the assembly is housed in the case 103, if a guide protrusion or the like is provided in the case 103, the assembly can be accurately arranged at a predetermined position in the case 103.

In the filling step, the mixture containing the magnetic powder and the resin that form the outer core portion 203 is filled in the case 103. Regarding the mixture of the magnetic powder and the resin (before the resin is hardened), if the contained amount of the magnetic powder is in a range from 20% to 60% by volume and the contained amount of the resin is in a range from 40% to 80% by volume with respect to the entire mixture, the outer core portion 203 with a relative permeability in a range from 5 to 50 can be formed. For example, pure iron powder with a phosphate coating may be prepared for the magnetic powder by 40% by volume, bisphenol-A epoxy resin may be prepared for the resin by 60% by volume, acid anhydride may be prepared for a hardening agent of this resin, and the mixture of these may be formed and filled in the case 103. Further, after the filling, evacuation may be preferably performed for deaeration for removing a void in the mixture. This is preferable because a void in the mixture can be removed and a desirable magnetic property can be easily obtained for the outer core portion 203.

In the hardening step, the filled resin is hardened. In this hardening step, a temperature and a period of time may be preferably selected in accordance with the kind of resin to be hardened. In this example, the resin is hardened by leaving the resin in a state in which the temperature is held at a first temperature of 80° C. for two hours, then in a state in which the temperature is held at a second temperature of 120° C. for two hours, and then in a state in which the temperature is held at a third temperature of 150° C. for five hours.

The first temperature is selected as a temperature at which the viscosity of the resin becomes the lowest. The temperature can be checked by measuring the viscosity of the resin after the hardening agent is mixed but before hardening progresses, under the same condition while the temperature is changed. If such a temperature is used, the magnetic powder in the resin is likely precipitated, resulting in that a difference in concentration can be provided. That is, a difference in density of the mixture appears between a bottom-surface side and an upper-surface side. Owing to this, the first temperature is preferably within ±5° C. of the temperature at which the viscosity becomes the lowest, and more preferably within ±3° C. Further, since the viscosity is low, an advantage that the void in the resin is easily removed can be additionally obtained. Thus, a characteristic that the hardened resin does not have a void with a diameter of 200 μm or larger can be also obtained. The second temperature is for hardening the resin. The third temperature is for increasing the cross-linking density of the resin. In particular, by selecting the first temperature based on the findings that have been previously tested, the difference in density between the bottom-surface side and the upper-surface side can be desirably formed. The second temperature and the third temperature may be held for required periods of time that are selected for hardening and cross-linking the resin.

In the above-described step, the three heating temperatures of the first, second, and third temperatures are held for predetermined periods of time. However, if the heat resistance property is not required to be high and the cross-linking density of the resin is not so required to be high, a step may be alternatively performed in which two heating temperatures of only the first and second temperatures are held for predetermined periods of time. Still alternatively, the second temperature may be omitted, and a step may be performed in which two heating temperatures of only the first and third temperatures are held for predetermined periods of time.

In the case in which the injection molding or cast molding is used, the permeability of the outer core portion can be adjusted by changing the contained amounts of the soft magnetic powder (or non-magnetic powder) and the binder resin if sintering is not performed, or by changing the contained amounts of the soft magnetic powder and the non-magnetic powder if sintering is performed. For example, if the contained amount of the soft magnetic powder is decreased, the permeability tends to be decreased. The permeability of the outer core portion 203 is preferably adjusted so that the reactor 101 has a desirable inductance.

With this reactor 101, since the saturation magnetic flux density of the inner core portion 202 is higher than that of the outer core portion 203, if the total magnetic flux passing through the inner core portion 202 is equivalent to the total magnetic flux passing through an inner core of a magnetic core (a uniform core) having a shape similar to the shape of the core of the reactor 101 and entirely having a uniform saturation magnetic flux density, the cross-section area of the inner core portion 202 (a plane through which the magnetic flux passes) can be smaller than the cross-section area of the inner core of the uniform core. Since the inner core portion 202 is downsized, the core 204 can be downsized, and as the result, the reactor 101 can be downsized. Also, with the reactor 101, since the inner core portion 202 has the high saturation magnetic flux density and the outer core portion 203 has the low permeability, the reactor 101 can have a desirable inductance.

Further, with the reactor 101, if a gap is not present entirely in the core 204, a phenomenon in which a magnetic flux leaking at the gap affects the coil 201 does not occur. Hence, the inner core portion 202 can be arranged closely to the inner peripheral surface of the coil 201. Accordingly, the gap between the outer peripheral surface of the inner core portion 202 and the inner peripheral surface of the coil 201 can be decreased. Also in this point of view, the reactor 101 can be downsized.

In addition, if the reactor 101 does not use any adhesive, a bonding step for a gap member is not required when the inner core portion 202 is formed, resulting in good productivity. In particular, with the reactor 101, the inner core portion 202 and the outer core portion 203 are bonded together by the forming resin of the outer core portion 203 to form the core 204 simultaneously when the outer core portion 203 is formed, and as the result, the reactor 101 can be manufactured. Accordingly, the manufacturing steps are simplified, and also in this point of view, the productivity is increased.

Further, with the reactor 101, since the inner core portion 202 is the powder compact, the saturation magnetic flux density can be easily adjusted, and even if the inner core portion 202 has a complicated three-dimensional shape, the inner core portion 202 can be easily formed. In addition, since the outer core portion 203 has a resin component, the outer core portion 203 can be protected from the external environment, such as dust and corrosion, and can be mechanically protected. In particular, with the reactor 101, since the coil 201 is entirely covered with the outer core portion 203, the outer core portion 203 can be easily formed and can sufficiently protect the coil 201. As described above, the reactor 101 have various advantages.

Further, even if the outer core portion 203 of the reactor 101 is formed of the mixture of the magnetic material and the resin as described above, a desirable inductance value can be easily achieved. When the outer core portion 203 is hardened in the case 103 by the above-described manufacturing method, the magnetic material is distributed more at the bottom side of the case 103 and is distributed less at the upper side of the case 103 by gravity. Owing to this, the difference in concentration of the magnetic material becomes large in a direction 206 along the side walls of the case 103. For example, even if the resin is hardened without the difference in density being intentionally provided, the difference in density may be generated by ±1% or smaller, or smaller than ±2% even at maximum by slight precipitation due to gravity and a variation in concentration. If an end surface of the cylindrical coil 201 faces the bottom surface of the case 103 (if the coil 201 is vertically arranged in the case 103), a magnetic circuit is formed in the direction 206 in which the difference in concentration of the magnetic material is large. It may become difficult to achieve the inductance of the designed value. In contrast, the difference in concentration of the magnetic material in the horizontal direction can be markedly smaller than as compared with that in the direction 206.

The concentration of the magnetic material in one direction can be evaluated through a density measurement of sliced pieces (excluding the volumes of the coil 201 and the inner core portion 202) when the outer core portion 203 is sliced at a predetermined interval in a plane the normal of which is the one direction. In this case, the difference in concentration of the magnetic material in the one direction can be calculated by using the minimum density and the maximum density from among the densities of the sliced pieces, with reference to the maximum density, based on (maximum density−minimum density)/maximum density.

A density ρ can be measured from the weight in the air and the weight in water. Based on the Archimedean principle, the density ρ is expressed as follows:

$$\rho=(\rho w\times Wair-\rho air\times Ww)/(Wair-Ww),$$

where ρw is a density of water, ρair is a density of the air, Ww is a weight in water, and Wair is a weight in the air.

Approximately, since ρw>>ρair, the density ρ can be expressed as follows:

$$\rho\approx\rho w\times Wair/(Wair-Ww).$$

In the reactor 101, the axial direction 205 of the coil 201 is substantially parallel to the bottom surface of the case 103 along the direction in which the difference in density is small, and the end surfaces of the coil 201 face the side walls of the case 103 (the coil 201 is horizontally arranged in the case 103). The magnetic material is distributed more at the bottom-surface side in the case 103 and the magnetic circuit is formed at that portion in a concentrated manner. As a whole, the inductance of the designed value is easily achieved regardless of the concentration distribution of the magnetic material in the manufacturing process. As the result, the manufacturing cost of the reactor 101 decreases.

It is to be noted that although the axial direction 205 of the coil 201 is preferably the horizontal direction (or substantially parallel to the bottom surface of the case 103) from the filling step to the hardening step. However, as long as the end surfaces of the cylindrical coil 201 face the side walls of the case 103, the difference in concentration of the magnetic material in the magnetic flux direction can be suppressed as compared with the case in which the end surface of the coil 201 faces the bottom surface of the case 103.

Further, if the coil 201 is arranged such that the axial direction of the coil 201 is substantially parallel to the bottom surface of the case 103 and the end surfaces of the coil 201 face the side walls of the case 103, the heat-radiation performance of the reactor 101 increases. The outer core portion 203 that is formed of the mixture of the magnetic material and the resin has a lower thermal conductivity than that of the inner core portion 202 that is formed of the powder compact, and hence the temperature of the reactor likely increases by heat from the coil 201 that is covered with the outer core portion 203. If the coil 201 is arranged such that the end surface of the coil 201 faces the bottom surface instead of the side wall of the case 103, the outer peripheral surface of the coil 201, which occupies a major part of the outer surface of the coil 201, faces the side walls of the case 103. In this case, the heat generated from the coil 201 is mainly dissipated through a path extending from the inner core portion 202 to the bottom surface of the case 103 and a path extending to the bottom surface through the outer core portion 203 and the side walls of the case 103. If the heat radiation is performed through these paths, the temperature of the entire reactor 101 likely increases.

In contrast, if the coil 201 is arranged such that the end surfaces of the coil 201 face the side walls of the case 103, the outer peripheral surface of the coil 201 faces the bottom surface of the case 103. Since the surface area of the coil 201 facing the bottom surface, which serves as the heat-radiation surface, of the case 103 increases, even if the coil 201 is covered with the outer core portion 203, the heat from the coil 201 is likely dissipated from the bottom surface of the case 103. Hence, the reactor 101 likely achieves a desirable inductance value, and good heat-radiation performance can be ensured.

In the point of view, if the coil 201 is arranged such that the outer peripheral surface of the coil 201 directly comes into contact with the bottom surface of the case 103 or through an insulating member, the heat-radiation performance further desirably increases. The outer core is not substantially present at the contact portion. However, the outer core functions without any problem.

Figure 3:
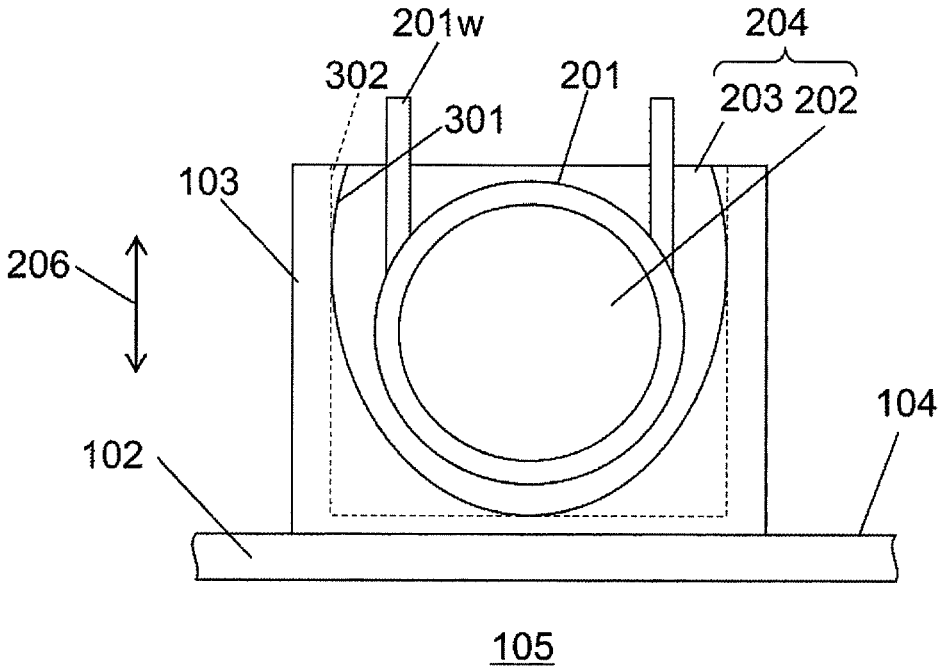
FIG. 3 is an illustration for explaining a configuration example of a reactor in which an inner wall surface of a case is non-similar to an outer wall surface of the case.

FIG. 3 is an illustration for explaining a configuration example of a reactor in which an inner wall surface of a case is non-similar to an outer wall surface of the case. In this example, an inner wall surface 301 of a case 103 has a substantially semi-elliptic cross-sectional shape to correspond to the external shapes of the coil 201 and the inner core portion 202. The external shape of the case 103 is a rectangular-parallelepiped, and hence the inner wall surface and the outer wall surface of the case 103 are non-similar to each other. An imaginary line 302 imaginarily indicates an inner wall surface if the inner wall surface is formed in a shape of a rectangular-parallelepiped that is similar to the outer wall surface of the case 103.

As it is found through comparison between the inner wall surface 301 and the imaginary line 302 in the figure, since an inner wall surface 301 of the case 103 is formed to correspond to the external shapes of the coil 201 and the inner core portion 202, the inner wall surface of the case 103 is close to the coil 201 and the inner core portion 202 evenly at respective positions. As compared with a case in which the inner wall surface of the case 103 is similar to the outer wall surface, the surface area of the inner wall surface 301 facing the coil 201 and the inner core portion 202 at a distance within a constant distance can increase. Owing to this, the heat from the coil 201 and the like can be likely dissipated from the inner wall surface 301, and the heat-radiation performance of the reactor increases.

It is to be noted that the cross-sectional shape of the inner wall surface 301 does not have to be the substantially semi-elliptic shape, and may be a semicircular shape or other shape to correspond to the external shapes of the coil 201 and the inner core portion 202. Also, the inner wall surface of the case may be formed to correspond to the external shape of the coil 201 or the external shape of the inner core portion.

Figure 4:
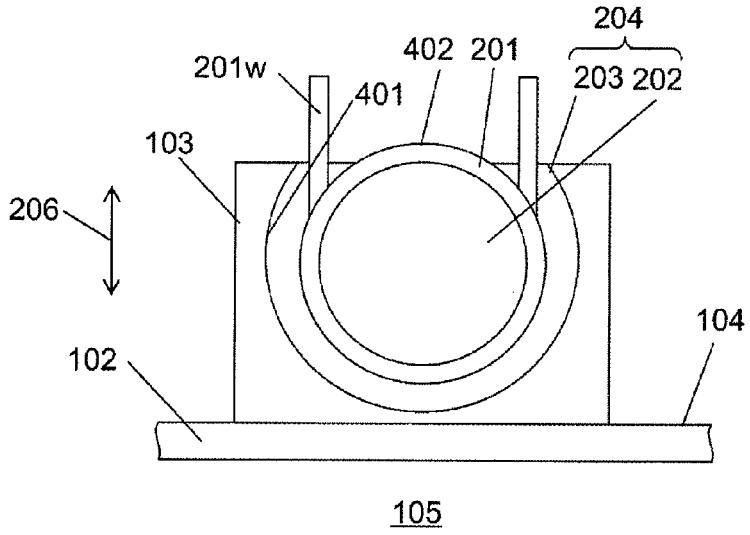
FIG. 4 is an illustration showing a configuration example of a reactor in which part of an outer peripheral surface of a coil is exposed from an outer core portion.

FIG. 4 is an illustration showing a configuration example of a reactor in which part of an outer peripheral surface of a coil is exposed from an outer core portion. In this example, an inner wall surface 401 of a case 103 has a substantially semi-circular cross-sectional shape to correspond to the external shapes of the coil 201 and the inner core portion 202. Hence, the heat-radiation performance of the reactor increases because of the shape of the inner wall surface 401 like the example in FIG. 3. However, the inner wall surface of the case 103 may be other shape.

In the example in FIG. 4, further, part of an outer peripheral surface 402 of the coil 201 is exposed from an outer core portion 203 at the upper side of the case 103. When the coil 201 is vertically arranged in the case 103, if the coil 201 is exposed from the outer core portion 203, there is generated part where the outer core portion 203 is not present along the whole periphery of the outer peripheral surface of the coil 201. In contrast, when the coil 201 is horizontally arranged in the case 103, even if the outer peripheral surface 402 of the coil 201 is partly exposed, the other part of the outer core portion 203 is continued in the axial direction 205 of the coil 201. Hence, a required magnetic circuit can be ensured at the part of the outer peripheral surface 402 in the outer core portion 203. Since the magnetic circuit is formed at the bottom-surface side of the case 103 in a concentrated manner, if the outer peripheral surface 402 of the coil 201 is exposed at the upper side of the case 103, the influence on the inductance value is particularly small, and an inductance of a designed value for the entire reactor is easily achieved.

If part of the outer peripheral surface 402 of the coil 201 is exposed from the outer core portion 203 at the upper side of the case 103, the heat of the coil 201 can be dissipated not through the outer core portion 203. Since the upper side of the case 103 is the most far from the bottom surface serving as the heat-radiation surface of the case 103, the temperature likely rises. Since part of the outer peripheral surface 402 of the coil 201 is exposed at the upper side of the case 103, the heat-radiation performance of that part increases. Hence, a desirable inductance value can be ensured and the heat-radiation performance of the entire reactor can further increase.

In each of the examples in FIGS. 3 and 4, the case 103 may have a lid that closes the upper side. If the upper side of the case 103 is closed with, for example, a lid made of aluminum, the outer core portion 203 and the upper surface of the coil 201 exposed from the outer core portion 203 can be in contact with the lid. In this case, the heat at the upper side of the reactor can be dissipated through the lid, the side walls of the case 103, and also through a path extending to the bottom surface. Owing to this, the heat-radiation performance of the reactor further increases. The material of the lid may use a metal material such as aluminum or an aluminum alloy, or a ceramic such as silicon nitride, alumina, aluminum nitride, boron nitride, or silicon carbide. It is to be noted that if the case is closed with a lid of a conductive material in the example shown in FIG. 4, insulation has to be provided between the coil 201 and the lid.

Figure 5A:
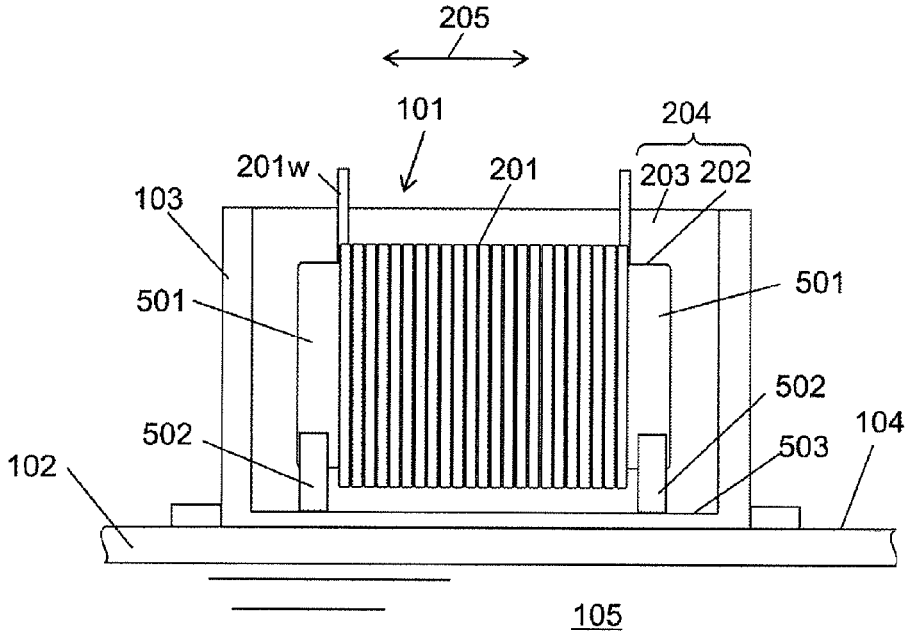
FIG. 5A is a front view for explaining a configuration example of a reactor in which a support portion for a coil is provided in a case.
Figure 5B:
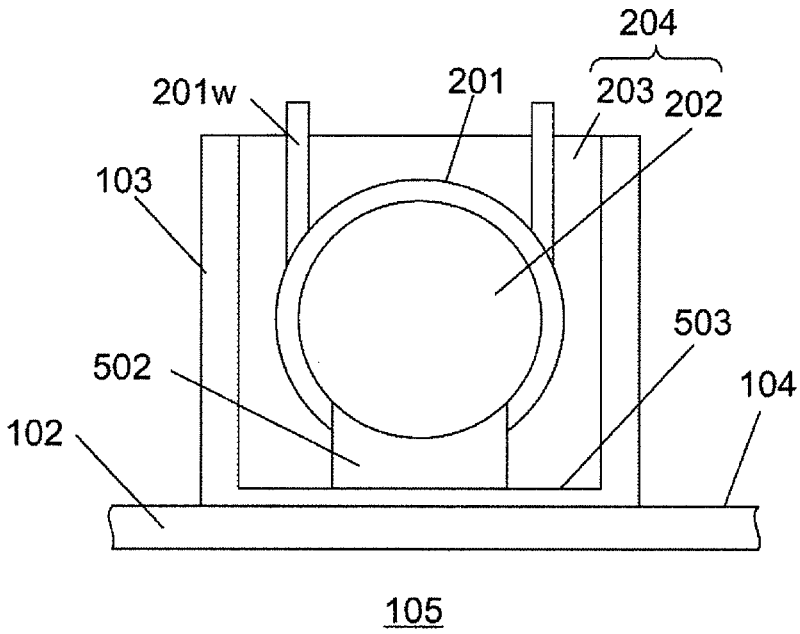
FIG. 5B is a side view for explaining a configuration example of a reactor in which a support portion for a coil is provided in a case.

FIGS. 5A and 5B are a front view and a side view for explaining a configuration example of a reactor in which a support portion for a coil is provided in a case. In this example, the reactor includes support portions 502 on an inner bottom surface 503 of the case 103. The support portions 502 support the coil 201 and the inner core portion 202 by supporting both end portions 501 of the inner core portion 202 protruding from the coil 201. The support portions 502 may be integrally formed with a main body of the case 103, or may be formed separately from the main body of the case 103 and may be coupled and fixed to the main body of the case 103. The material of the support portions 502 may be the same as the material of the case 103, or may be different from the material of the case 103. The material similar to that of the lid of the case may be used for the support portions 502.

Since the support portions 502 are provided in the case 103, or in this embodiment, on the inner bottom surface 503 of the case 103, the coil 201 can be easily positioned in the case 103. The forming member of the outer core portion 203 is filled in the case 103 while the coil 201 is placed on the support portions 502, is molded, and is hardened. Thus, the reactor according to this example can be manufactured. Accordingly, the reactor that achieves a desirable inductance value can be further easily manufactured.

The support portions 502 come into contact with the inner core portion 202 at both end portions 501 of the inner core portion 202 protruding from the coil 201. The coil 201 does not come into contact with the support portions 502. Also, the support portions 502 are vertically arranged on the inner bottom surface 503 of the case 103. The coil 201 does not come into contact with the inner bottom surface 503 of the case 103. Hence, merely by placing the coil 201 on the support portions 502, insulation is ensured between the case 103 and the coil 201.

The support portion 502 structurally couples the inner core portion 202 and the inner bottom surface 503 of the case 103.

Heat can be dissipated from both end portions 501 of the inner core portion 202 to the bottom surface of the case 103 through the support portions 502. Accordingly, by providing the support portions 502, the heat-radiation performance of the entire reactor can increase. To ensure insulation between the case 103 and the coil 201, the heat-radiation performance still increases if the inner bottom surface 503 of the case 103 is close to the coil 201.

The above-described embodiment does not limit the technical scope of the present invention, and various modifications and applications can be made within the scope of the present invention. For example, the application of the reactor of the present invention is not limited to the vehicle-mounted converter, and the reactor can be applied to other power converter with a relatively high output, such as a converter for an air conditioner. Further, the end surface of the inner core portion may be in contact with the side wall of the case. If the end surface of the inner core portion comes into contact with the side wall of the case, the heat-radiation performance of the reactor can further increase.

In the above-described embodiment, the present invention has been described as the reactor the inner core portion of which is mainly formed of the powder compact. For another example, the inner core portion may use a configuration formed of a stack in which electromagnetic steel sheets, which are typically silicon steel sheets, are stacked. The electromagnetic steel sheets more easily provide a magnetic core with a high saturation magnetic flux density than the powder compact does. Further, in the above-described reactor, the inner core portion has the higher saturation magnetic flux density than that of the outer core portion, and the outer core portion has the lower permeability than that of the inner core portion. However, the reactor to which the present invention is applied is not limited to the example. For example, not only the outer core portion but also the inner core portion may be formed of the mixture of the magnetic material and the resin.

EXAMPLES

[Formation of Difference in Density]

The difference in concentration of a magnetic material can be a desirable value according to certain conditions, such as a hardening condition, a filled amount of the magnetic material, a particle size, the kind of hardening agent, etc. Table I shows formation example. Commercially available pure iron powder was used as the magnetic material, and epoxy resin (bisphenol-A epoxy resin JER828 manufactured by Mitsubishi Chemical Corporation (formerly, Japan Epoxy Resins Co., Ltd.)) and a hardening agent shown in the table were mixed without using a filling member such as a filler. The hardening condition was the same, and heating was performed at 80° C. for two hours, at 120° C. for two hours, and at 150° C. for five hours in that order. The holding period of time of two hours at 80° C. is a period of time in which precipitation of the magnetic material is substantially saturated, and is in a state in which the difference in concentration is sufficiently provided between the bottom-surface side and the upper-surface side. Shorter the period of time, smaller the difference. The precipitation slightly progresses even during hardening at 120° C. However, in the examples, since a sufficient period of time is provided at 80° C., it is conceived that the influence of the precipitation on the difference in concentration is almost negligible.

In Table I, the height is a height of a filled portion serving as the outer core portion, i.e., a distance from the bottom surface of the case to the upper surface. The particle diameter range of the iron powder was measured by using a device manufactured by Nikkiso Co., Ltd. (Microtrac MT3300) through laser diffraction and scattering. The filled amount of the iron powder is a volume ratio of the iron powder to the entire mixture. The density at the bottom-surface side and the difference in density are the measurement results after hardening. A sample after hardening was equally divided into five parts from the bottom-surface side to the upper-surface side, and the densities of the respective parts were calculated and obtained by the above-described method. It is recognized that the density decreases from the bottom-surface side to the upper-surface side. The bottom-surface-side density is the density at the most bottom-surface side from among the divided parts, and serves as a maximum density. The difference in density was obtained based on (bottom-surface-side density−upper-surface-side density)/bottom-surface-side density.

TABLE I

| | | Example 1 | Example 2 | Example 3 | Example 4 | Example 5 | Example 6 | Example 7 | Example 8 |
|---|---|---|---|---|---|---|---|---|---|
| Height | mm | 60 | 40 | 40 | 40 | 40 | 40 | 30 | 30 |
| Particle diameter range of iron powder | μm | 75 or smaller | 75 or smaller | 75 or smaller | 75 or smaller | 38 or smaller | 38~75 | 75 or smaller | 75 or smaller |
| Filled amount of iron powder | vol % | 40 | 40 | 35 | 30 | 40 | 40 | 40 | 40 |
| Hardening agent | — | MH-700 | MH-700 | MH-700 | MH-700 | MH-700 | MH-700 | MH-700 | MTA-15 |
| Bottom-surface-side density | $g/cm^3$ | 4.515 | 4.552 | 4.435 | 4.423 | 4.649 | 4.408 | 4.415 | 4.409 |
| Density difference | % | 12.5 | 8.8 | 4.7 | 3.9 | 8.6 | 2.8 | 4.3 | 12.4 |

Hardening agent

MH-700: Manufactured by New Japan Chemical Co., Ltd. Acid anhydride

MTA-15: Manufactured by New Japan Chemical Co., Ltd. Acid anhydride

Regarding comparison among Example 1, Example 2, and Example 7, it is found that larger the filled height, larger the difference in density. Also, regarding comparison among Example 2, Example 3, and Example 4, it is found that larger the filled amount of the iron powder, larger the difference in density. Iron powder with a particle diameter of 75 μm or smaller was used in Example 1, iron powder with a particle diameter of 38 μm or smaller was selectively used in Example 5, and iron powder with a particle diameter in a range from 38 to 75 μm was selectively used in Example 6. The iron powder with a smaller particle diameter makes a contribution to the difference in density. Further, Example 7 and Example 8 provide comparison for different hardening agents. It is found that the difference in density can be changed even through selection of the hardening agent.

[Simulation 1 of Heat-Radiation Effect]

Figure 6:
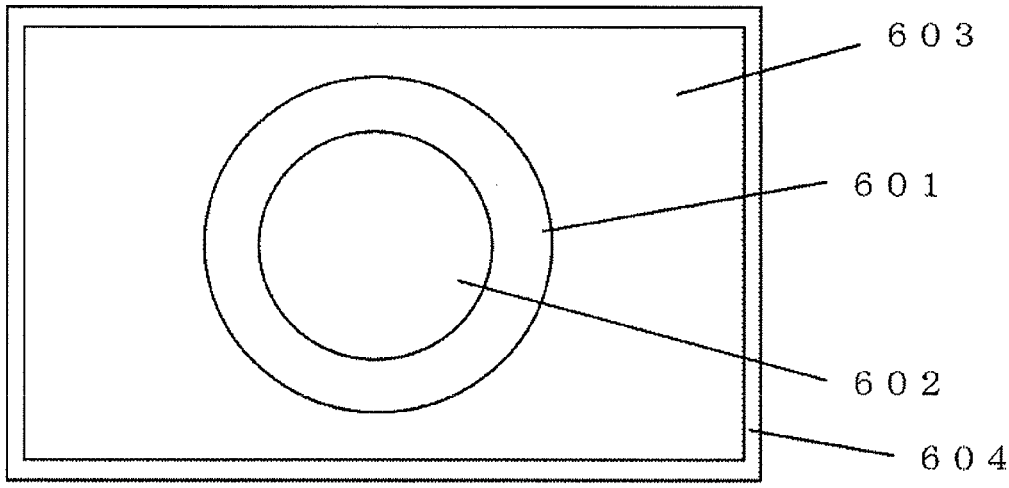
FIG. 6 is a schematic illustration explaining a cross-sectional structure of a simulated reactor.

Next, results of the difference in internal temperature due to the difference in density, and the heat-radiation effect recognized through a simulation are shown. FIG. 6 shows a simulated structure of a reactor. The structure of the reactor includes a cylindrical inner core portion 602, a coil 601 wound on the outer periphery of the inner core portion 602, an outer core portion 603 entirely covering the inner core portion 602 and the coil 601, and a case 604 that entirely houses these parts. The inner core portion 602 was a powder compact core having a uniform density of 7.27 g/cm$^3$ and dimensions with a diameter of 29.8 mm and a height of 61 mm. Also, the coil 601 is a wire member having dimensions with an inner diameter of 33.8 mm, a thickness of 0.8 mm, and a width of 9.0 mm, and the wire member is wound by 51 turns. The external shape of the case 604 is 9.12×74.2×60 mm.

The outer core portion 603 was a mixture of a magnetic material and a resin, and had external dimensions of 87.2×70.2×56 mm. The outer core portion has differences in density by 10 equal steps from the bottom surface to the upper surface. Table II shows conditions of the respective parts with the differences in density, in which vol % represents a percentage by volume of a magnetic substance of each part of the outer core portion, D represents a density (g/cm$^3$) of each part, μ represents a relative permeability of each part, W represents an iron loss (magnetic flux density amplitude Bm=0.1 T) (kW/m$^3$) with 10 kHz of each part, and λ is a thermal conductivity (W/mK) of each part. Also, the saturation magnetic flux density of each part falls within a range from 0.8 to 1.1 T.

TABLE II

| No. | vol % | D | μ | W | λ |
|---|---|---|---|---|---|
| 1 | 41.6 | 3.958 | 5.841 | 402.4 | 1.410 |
| 2 | 42.6 | 4.022 | 6.147 | 401.4 | 1.493 |
| 3 | 43.5 | 4.085 | 6.452 | 400.3 | 1.582 |
| 4 | 44.5 | 4.149 | 6.758 | 399.3 | 1.678 |
| 5 | 45.4 | 4.212 | 7.064 | 398.3 | 1.781 |
| 6 | 46.4 | 4.276 | 7.370 | 397.3 | 1.891 |
| 7 | 47.3 | 4.339 | 7.675 | 396.3 | 2.010 |
| 8 | 48.2 | 4.403 | 7.981 | 395.3 | 2.139 |
| 9 | 49.2 | 4.466 | 8.287 | 394.3 | 2.277 |
| 10 | 50.1 | 4.530 | 8.593 | 393.3 | 2.426 |

Figure 7:
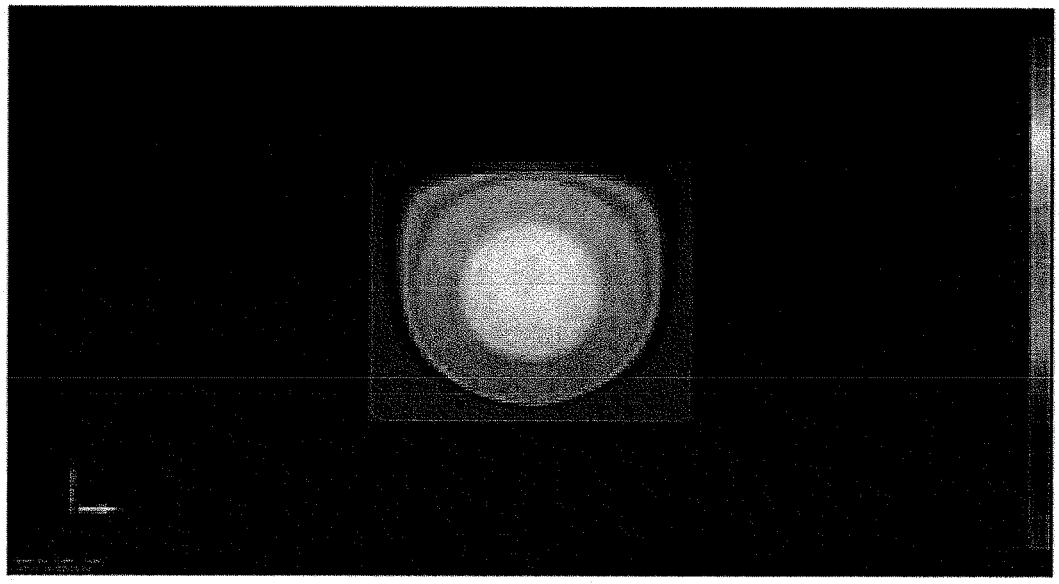
FIG. 7 is an illustration that expresses a cross-section temperature distribution in the form of a color distribution (with difference in density, bottom-surface side cooling), as the result of Simulation 1.
Figure 8:
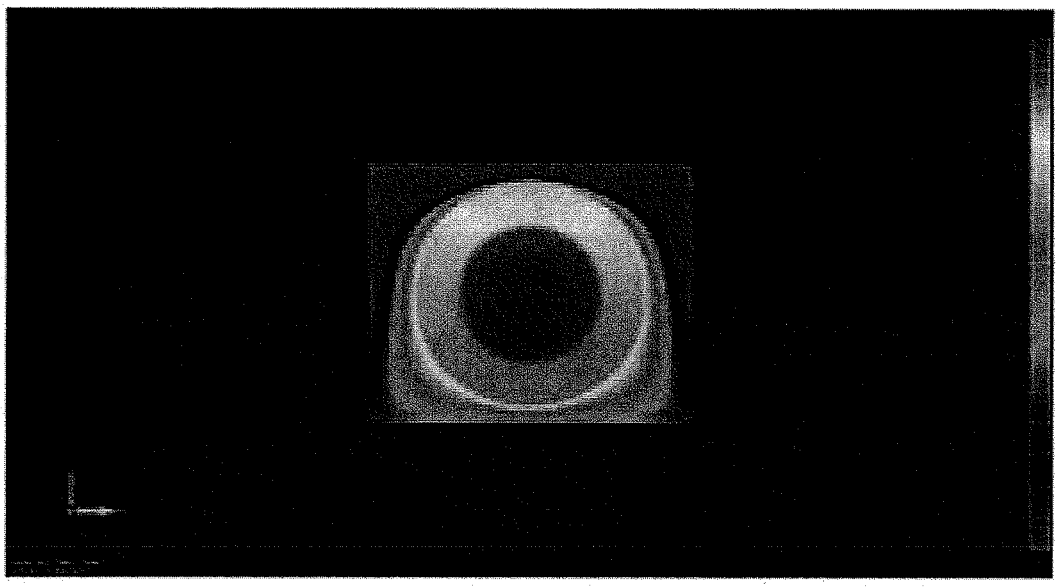
FIG. 8 is an illustration that expresses a cross-section temperature distribution in the form of a color distribution (with difference in density, upper-surface side cooling), as the result of Simulation 1.
Figure 9:
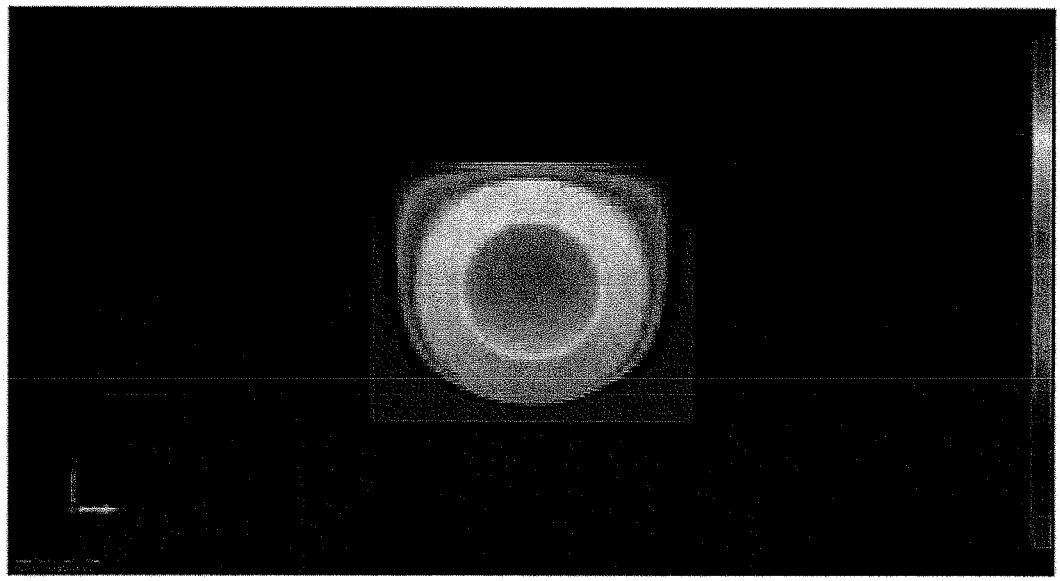
FIG. 9 is an illustration that expresses a cross-section temperature distribution in the form of a color distribution (without difference in density, bottom-surface side cooling), as the result of Simulation 1.
Figure 10:
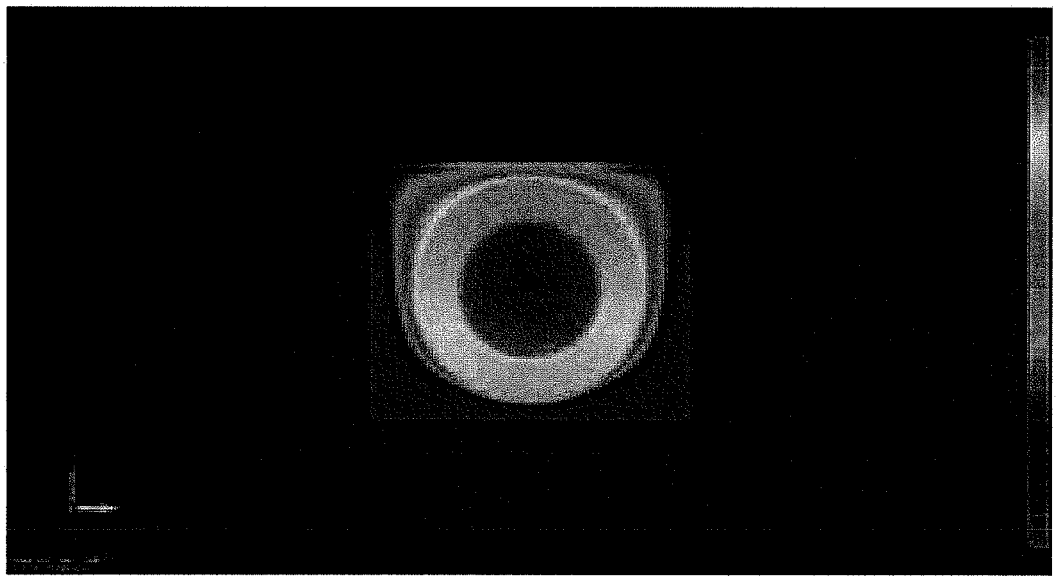
FIG. 10 is an illustration that expresses a cross-section temperature distribution in the form of a color distribution (0% difference in density), as the result of Simulation 2.
Figure 11:
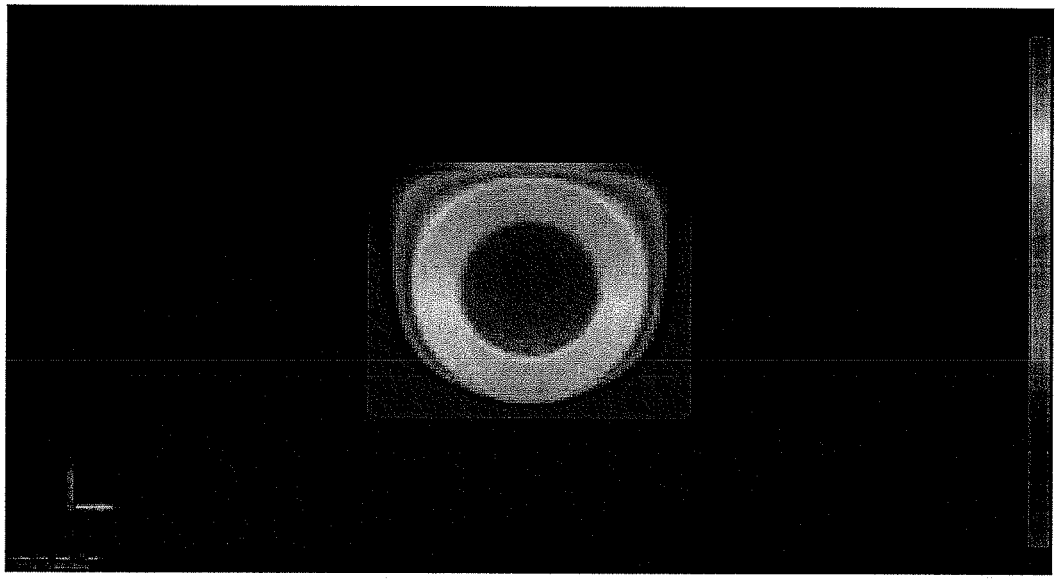
FIG. 11 is an illustration that expresses a cross-section temperature distribution in the form of a color distribution (2% difference in density), as the result of Simulation 2.
Figure 12:
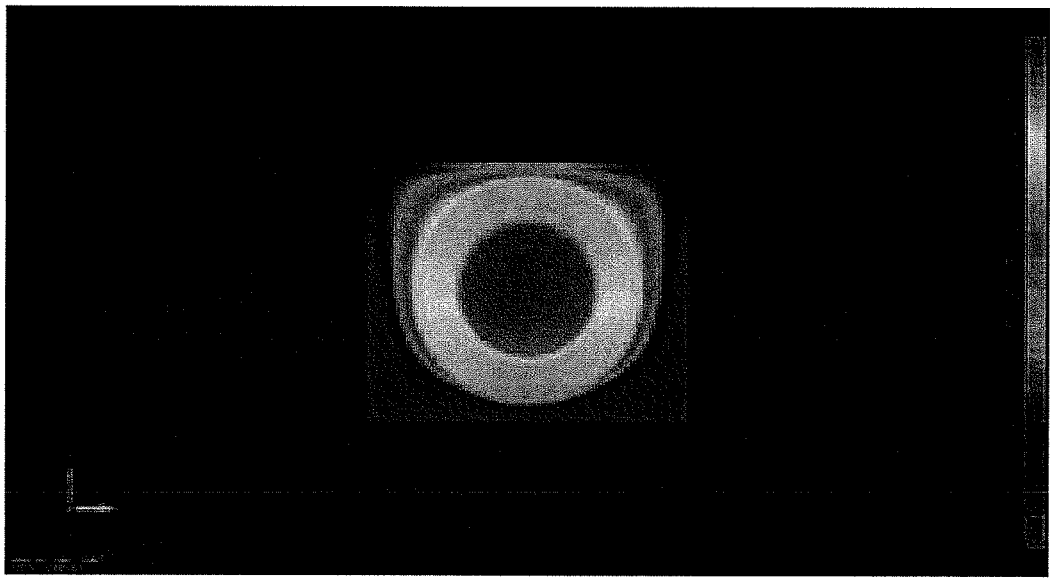
FIG. 12 is an illustration that expresses a cross-section temperature distribution in the form of a color distribution (3% difference in density), as the result of Simulation 2.
Figure 13:
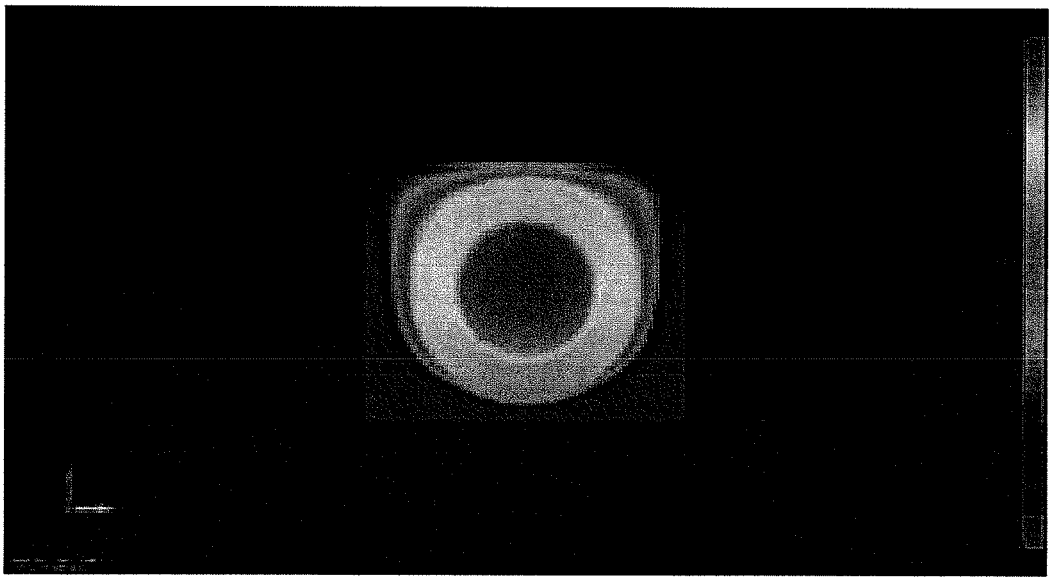
FIG. 13 is an illustration that expresses a cross-section temperature distribution in the form of a color distribution (5% difference in density), as the result of Simulation 2.
Figure 14:
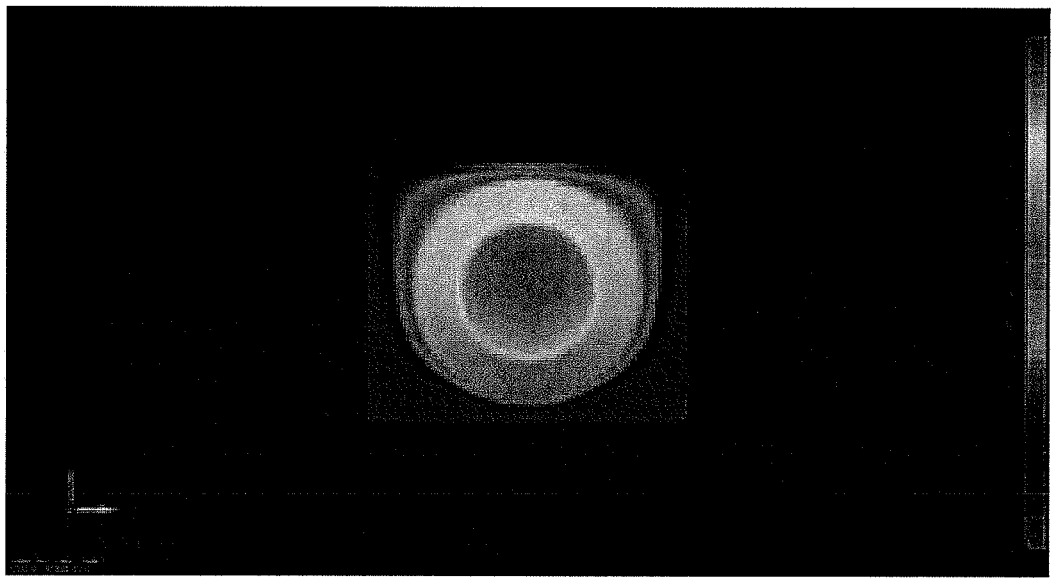
FIG. 14 is an illustration that expresses a cross-section temperature distribution in the form of a color distribution (10% difference in density), as the result of Simulation 2.
Figure 15:
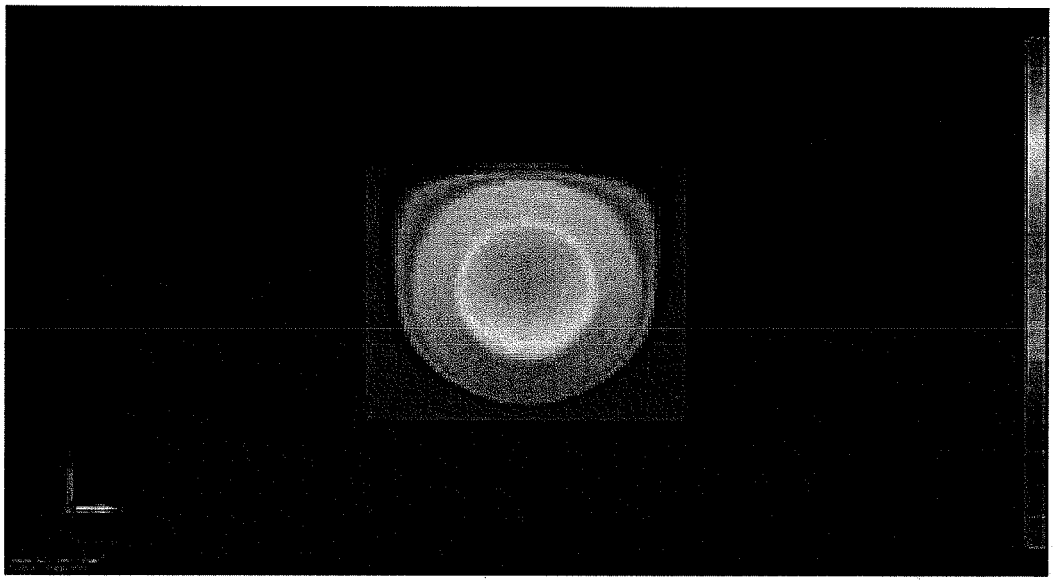
FIG. 15 is an illustration that expresses a cross-section temperature distribution in the form of a color distribution (15% difference in density), as the result of Simulation 2.
Figure 16:
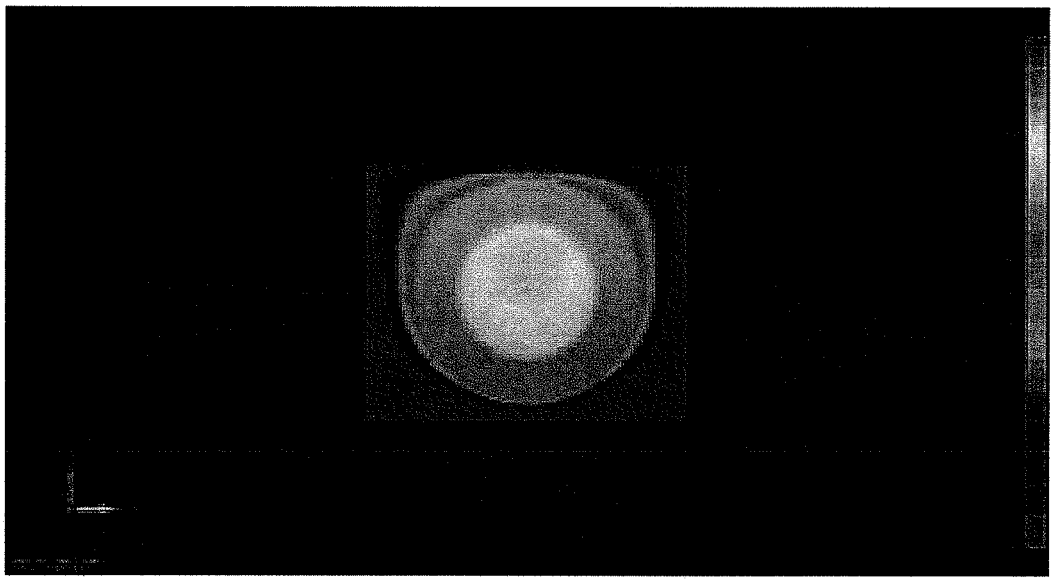
FIG. 16 is an illustration that expresses a cross-section temperature distribution in the form of a color distribution (20% difference in density), as the result of Simulation 2.
Figure 17:
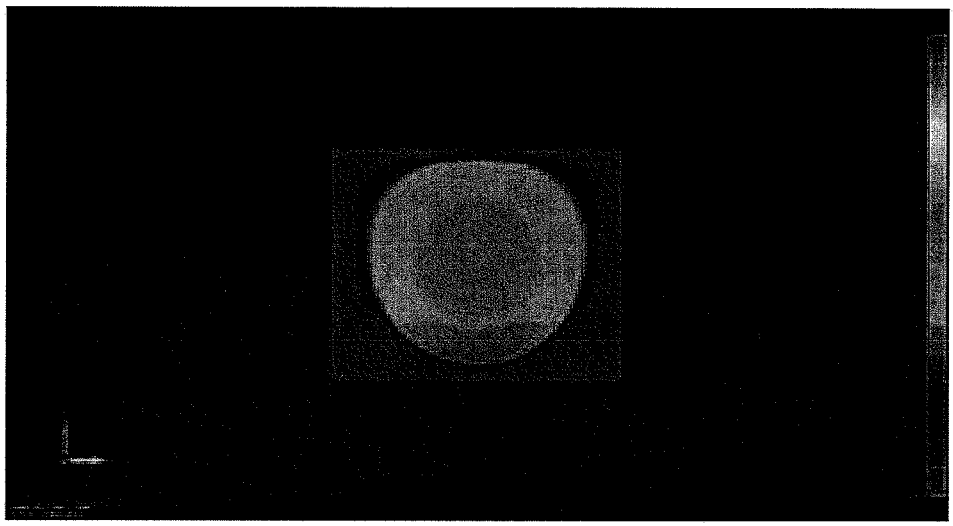
FIG. 17 is an illustration that expresses a cross-section temperature distribution in the form of a color distribution (45% difference in density), as the result of Simulation 2.

FIGS. 7 to 9 show first simulation results. Losses respectively for the coil, inner core, outer core, and case were calculated by magnetic field analysis and the results were handled as heat generating sources by thermal analysis. Also, a drive frequency was 10 kHz, an electricity application condition was 45 A, and a cooling-side temperature for forced cooling was 50° C. Each figure expresses a temperature distribution in a cross section in the form of a relative color distribution. Colors represents temperatures such that red represents the maximum temperature, yellow, green, and blue represent temperatures that decrease in that order, and purple represents the minimum temperature. The lower side in each figure is the bottom-surface side, and the upper side is the upper-surface side. FIGS. 7 and 8 show the outer cores in Table II, and FIG. 9 shows an outer core without a difference in density but with a uniform density for comparison. In FIG. 7, the lower side is the bottom-surface side (the high-density side). The bottom-surface side is forcedly cooled. Similarly in FIG. 8, the lower side is the bottom-surface side (the high-density side). The upper-surface side is forcedly cooled. FIG. 9 shows a case of a uniform density. The bottom-surface side is forcedly cooled.

The results of FIGS. 7 and 8 were compared with each other. it was found that if the cooling surface was arranged at the high-density side (the bottom-surface side), the maximum temperature was lowered by 6° C. and the heat could be efficiently radiated as compared with a case in which the cooling surface was arranged at the low-density side (the upper-surface side). In short, making a difference in density and cooling the side with a high density are effective.

When the results shown in FIGS. 7 and 9 are compared with each other, the difference between the maximum temperatures in the case with a difference in density and the case without a difference in density was 3° C., and it was found that heat could be radiated more efficiently if the difference in density was present.

[Simulation 2 of Heat-Radiation Effect]

Next, the results of a specific simulation by changing the difference in density is shown in order to find the detail of the difference in cooling effect due to the difference in density of the outer core portion. External dimension conditions of a reactor set for a simulation subject are the same as those of the above-described simulation 1. Cooling effect was checked by setting the densities of an outer core portion by 10 steps between the bottom-surface side and the upper-surface side, changing the difference in density, such as 0%, 2%, 3%, 5%, 10%, 15%, and 20% to provide Analysis Examples 1 to 7, obtaining the temperature distribution in a cross section according to each of Analysis Examples 1 to 7, and obtaining the maximum temperature of each of Analysis Examples 1 to 7. Table III shows the density (g/cm$^3$), Table IV shows the thermal conductivity (W/mK), Table V shows the relative permeability, and Table VI shows the iron loss (magnetic flux density amplitude Bm=0.1 T) (kW/m$^3$), which are set in each analysis example as simulation conditions.

TABLE III

| [Density] | Analysis example 1 | Analysis example 2 | Analysis example 3 | Analysis example 4 | Analysis example 5 | Analysis example 6 | Analysis example 7 | Analysis example 8 |
|---|---|---|---|---|---|---|---|---|
| Density difference [%] | 0 | 2 | 3 | 5 | 10 | 15 | 20 | 45 |
| 1 | 4.244 | 4.201 | 4.179 | 4.135 | 4.020 | 3.900 | 3.772 | 3.012 |
| 2 | 4.244 | 4.211 | 4.194 | 4.159 | 4.070 | 3.976 | 3.877 | 3.286 |

TABLE III-continued

| [Density] | Analysis example 1 | Analysis example 2 | Analysis example 3 | Analysis example 4 | Analysis example 5 | Analysis example 6 | Analysis example 7 | Analysis example 8 |
|---|---|---|---|---|---|---|---|---|
| 3 | 4.244 | 4.220 | 4.208 | 4.183 | 4.120 | 4.053 | 3.982 | 3.559 |
| 4 | 4.244 | 4.230 | 4.222 | 4.208 | 4.169 | 4.129 | 4.087 | 3.833 |
| 5 | 4.244 | 4.239 | 4.237 | 4.232 | 4.219 | 4.206 | 4.191 | 4.107 |
| 6 | 4.244 | 4.249 | 4.251 | 4.256 | 4.269 | 4.282 | 4.296 | 4.381 |
| 7 | 4.244 | 4.258 | 4.265 | 4.280 | 4.318 | 4.359 | 4.401 | 4.655 |
| 8 | 4.244 | 4.268 | 4.280 | 4.304 | 4.368 | 4.435 | 4.506 | 4.928 |
| 9 | 4.244 | 4.277 | 4.294 | 4.328 | 4.418 | 4.511 | 4.611 | 5.202 |
| 10 | 4.244 | 4.287 | 4.308 | 4.353 | 4.467 | 4.588 | 4.715 | 5.476 |

TABLE IV

| [Thermal conductivity] | Analysis example 1 | Analysis example 2 | Analysis example 3 | Analysis example 4 | Analysis example 5 | Analysis example 6 | Analysis example 7 | Analysis example 8 |
|---|---|---|---|---|---|---|---|---|
| Density difference [%] | 0 | 2 | 3 | 5 | 10 | 15 | 20 | 45 |
| 1 | 1.835 | 1.762 | 1.726 | 1.657 | 1.491 | 1.338 | 1.197 | 0.650 |
| 2 | 1.835 | 1.778 | 1.750 | 1.694 | 1.560 | 1.433 | 1.312 | 0.802 |
| 3 | 1.835 | 1.794 | 1.774 | 1.733 | 1.633 | 1.536 | 1.440 | 1.000 |
| 4 | 1.835 | 1.810 | 1.798 | 1.773 | 1.711 | 1.648 | 1.584 | 1.262 |
| 5 | 1.835 | 1.827 | 1.823 | 1.814 | 1.792 | 1.770 | 1.746 | 1.614 |
| 6 | 1.835 | 1.843 | 1.848 | 1.856 | 1.879 | 1.903 | 1.929 | 2.094 |
| 7 | 1.835 | 1.860 | 1.873 | 1.900 | 1.970 | 2.049 | 2.135 | 2.755 |
| 8 | 1.835 | 1.877 | 1.899 | 1.944 | 2.068 | 2.208 | 2.369 | 3.679 |
| 9 | 1.835 | 1.894 | 1.925 | 1.990 | 2.170 | 2.382 | 2.634 | 4.983 |
| 10 | 1.835 | 1.912 | 1.952 | 2.037 | 2.279 | 2.573 | 2.934 | 6.832 |

TABLE V

| [Relative permeability] | Analysis example 1 | Analysis example 2 | Analysis example 3 | Analysis example 4 | Analysis example 5 | Analysis example 6 | Analysis example 7 | Analysis example 8 |
|---|---|---|---|---|---|---|---|---|
| Density difference [%] | 0 | 2 | 3 | 5 | 10 | 15 | 20 | 45 |
| 1 | 7.217 | 7.010 | 6.906 | 6.693 | 6.141 | 5.560 | 4.946 | 1.284 |
| 2 | 7.217 | 7.056 | 6.975 | 6.809 | 6.380 | 5.928 | 5.451 | 2.603 |
| 3 | 7.217 | 7.102 | 7.044 | 6.926 | 6.619 | 6.296 | 5.955 | 3.921 |
| 4 | 7.217 | 7.148 | 7.113 | 7.042 | 6.858 | 6.664 | 6.460 | 5.239 |
| 5 | 7.217 | 7.194 | 7.182 | 7.158 | 7.097 | 7.033 | 6.964 | 6.558 |
| 6 | 7.217 | 7.240 | 7.251 | 7.275 | 7.336 | 7.401 | 7.469 | 7.876 |
| 7 | 7.217 | 7.286 | 7.320 | 7.391 | 7.575 | 7.769 | 7.974 | 9.194 |
| 8 | 7.217 | 7.331 | 7.390 | 7.508 | 7.814 | 8.137 | 8.478 | 10.512 |
| 9 | 7.217 | 7.377 | 7.459 | 7.624 | 8.053 | 8.505 | 8.983 | 11.831 |
| 10 | 7.217 | 7.423 | 7.528 | 7.741 | 8.292 | 8.874 | 9.487 | 13.149 |

TABLE VI

| [Iron loss] | Analysis example 1 | Analysis example 2 | Analysis example 3 | Analysis example 4 | Analysis example 5 | Analysis example 6 | Analysis example 7 | Analysis example 8 |
|---|---|---|---|---|---|---|---|---|
| Density difference [%] | 0 | 2 | 3 | 5 | 10 | 15 | 20 | 45 |
| 1 | 397.8 | 398.5 | 398.9 | 399.6 | 401.4 | 403.3 | 405.3 | 417.4 |
| 2 | 397.8 | 398.4 | 398.6 | 399.2 | 400.6 | 402.1 | 403.6 | 413.0 |
| 3 | 397.8 | 398.2 | 398.4 | 398.8 | 399.8 | 400.9 | 402.0 | 408.7 |
| 4 | 397.8 | 398.1 | 398.2 | 398.4 | 399.0 | 399.6 | 400.3 | 404.3 |
| 5 | 397.8 | 397.9 | 397.9 | 398.0 | 398.2 | 398.4 | 398.7 | 400.0 |
| 6 | 397.8 | 397.8 | 397.7 | 397.6 | 397.4 | 397.2 | 397.0 | 395.7 |
| 7 | 397.8 | 397.6 | 397.5 | 397.3 | 396.6 | 396.0 | 395.3 | 391.3 |
| 8 | 397.8 | 397.5 | 397.3 | 396.9 | 395.9 | 394.8 | 393.7 | 387.0 |
| 9 | 397.8 | 397.3 | 397.0 | 396.5 | 395.1 | 393.6 | 392.0 | 382.6 |
| 10 | 397.8 | 397.1 | 396.8 | 396.1 | 394.3 | 392.4 | 390.3 | 378.3 |

FIGS. 10 to 17 express differences in temperature distributions in cross sections obtained according to Analysis Examples 1 to 8 in the form of color distributions. As it is found through comparison among the figures, larger the difference in density, larger the appearance of the cooling effect, and the temperature is entirely maintained low. Table VII collectively shows the maximum temperatures of the inner core portion, coil, outer core portion, and case, the maximum temperature of the entire reactor, the loss of the entire reactor, and the inductance of the entire reactor when the coil direct current is OA (zero magnetic field) according to each of analysis examples in FIGS. 10 to 17. It is found from Table VII that the maximum temperature of the entire reactor corresponds to the maximum temperature of the inner core portion. If the difference in density is 2%, the maximum temperature can be decreased by 0.5° C. The cooling effect becomes large as the difference in density becomes large. If the difference in density is 20%, the maximum temperature can be decreased by 5.1° C.

TABLE VII

| | Analysis example 1 | Analysis example 2 | Analysis example 3 | Analysis example 4 | Analysis example 5 | Analysis example 6 | Analysis example 7 | Analysis example 8 |
|---|---|---|---|---|---|---|---|---|
| Density difference [%] | 0 | 2 | 3 | 5 | 10 | 15 | 20 | 45 |
| Maximum temperature [° C.] | 121.4 | 120.9 | 120.7 | 120.2 | 118.9 | 117.6 | 116.3 | 109.8 |
| Maximum temperature of inner core portion [° C.] | 121.4 | 120.9 | 120.7 | 120.2 | 118.9 | 117.6 | 116.3 | 109.8 |
| Maximum temperature of coil [° C.] | 117.8 | 117.3 | 117.1 | 116.5 | 115.3 | 114 | 112.6 | 105.9 |
| Maximum temperature of case [° C.] | 104.7 | 104.2 | 103.9 | 103.3 | 101.9 | 100.5 | 99.1 | 92.5 |
| Maximum temperature of outer core portion [° C.] | 115.8 | 115.3 | 115.1 | 114.6 | 113.5 | 112.2 | 111.0 | 105.0 |
| Loss [W] | 166.5 | 166.5 | 166.5 | 166.6 | 166.9 | 167.6 | 168.5 | 182.0 |
| Inductance (at 0 A) [μH] | 304.38 | 304.38 | 304.36 | 304.36 | 304.25 | 304.08 | 303.81 | 299.81 |

As described above, it was ensured that if the outer core portion has the difference in density and the bottom-surface side with a large density was forcedly cooled, the entire reactor could be effectively cooled. The heat-resistant temperature of epoxy resin and the heat-resistant temperature of electronic components etc. around the reactor are in a range from 140° C. to 150° C. The maximum temperatures of the respective portions of the reactor are inhibited from being these heat-resistant temperatures or higher. Thus, the maximum temperatures are desirably lower than the heat-resistance temperatures even slightly. By decreasing the temperature, effect of decreasing the loss of the coil is attained. Further, while the cooling temperature is 50° C. here, the cooling temperature may be possibly set at a temperature higher than 50° C. Hence, the temperatures of the respective portions of the reactor are desirably lower than the heat-resistance temperatures even slightly. Larger the difference in density, larger the cooling effect. In order to provide an effect of larger than 0.5° C. as the significant difference as compared with the case without the difference in density, the difference in density is preferably 3% or larger. To provide an effect of 1° C. or larger, the difference in density is preferably 5% or larger. To provide an effect of 2° C. or larger, the difference in density is preferably 10% or larger. When only the temperature difference is focused, the difference in density is preferably further large.

Meanwhile, if the difference in density increases, the inductance of the entire reactor decreases. The inductance is proportional to the square of the number of turns of the coil and to the cross-section area of the coil. In order to obtain the same inductance, the number of turns of the coil has to be increased, or the cross-section area of the coil has to be increased. The size of the entire reactor has to be increased. According to the above-described simulation, in Analysis Example 7 with the difference in density of 20%, the inductance is decreased by 0.2% as compared with Analysis Example 1. As the result of calculation in this point of view, it was found that the difference in density was preferably 45% or smaller in order to restrict a decrease in inductance by 1.5% or smaller, and the difference in density was more preferably 20% or smaller in order to restrict a decrease in inductance by 0.2% or smaller. Also, when the difference in density increases, the loss of the entire reactor also increases. It is conceived that the allowable range of an increase in loss for the vehicle-mounted purpose is up to about 10%. In order to restrict the increase in loss by 10% or smaller, the difference in density is preferably 45% or smaller. Further, in order to restrict the increase in loss by 1.5% or smaller, the difference in density is preferably 20% or smaller.

The embodiment and the examples disclosed herein are mere examples and do not intend to provide limitation. The scope of the present invention is not defined by the above description but is defined by the scope of the claims. It is intended that the scope of the present invention contains the meanings equivalent to the scope of the claims and all modifications within the scope of the claims.

INDUSTRIAL APPLICABILITY

The reactor according to the present invention can be used for a component of a power converter, for example, a converter mounted on a vehicle, such as a hybrid electric vehicle, a plug-in hybrid electric vehicle, an electric vehicle, or a fuel cell vehicle, or a converter mounted on an air conditioner.

| Reference Signs List | |
|---|---|
| 101 | reactor |
| 102 | converter case |
| 103 | case of reactor |
| 201 | coil |
| 201w | wire |
| 202 | inner core portion |
| 203 | outer core portion |
| 204 | core |
| 205 | axial direction of coil |
| 206 | direction along side wall of case |
| 301, 401 | inner wall surface of case |
| 402 | outer peripheral surface of coil |
| 501 | both end portions of coil |
| 502 | support portion |
| 503 | inner bottom surface of case |
| 601 | coil |

-continued

| Reference Signs List | |
|---|---|
| 602 | inner core portion |
| 603 | outer core portion |
| 604 | case |

The invention claimed is:

1. A reactor comprising: a coil; a core; and a case housing the coil and the core, the core including an inner core portion arranged inside the coil and an outer core portion partly or entirely covering the outside of the coil, the outer core portion being formed of a mixture of a magnetic material and a resin, wherein the coil is arranged such that the axial direction of the coil is substantially parallel to a bottom surface of the case, and wherein a difference in concentration of the magnetic material in the mixture in the outer core portion in the axial direction of the coil is smaller than a difference in concentration of the magnetic material in the mixture in the outer core portion in a direction along a side wall of the case, wherein the magnetic material in the outer core portion has a distribution of concentration in which the concentration decreases from a bottom-surface side of the case to an upper-surface side opposite to the bottom surface in the direction along the side wall, and the difference in concentration is larger than 0% and equal to or smaller than 45% with reference to the concentration at the bottom-surface side.

2. The reactor according to claim 1, wherein the difference in concentration is 3% or larger.

3. The reactor according to claim 1, wherein the bottom surface of the case is configured to be forcedly cooled.

4. The reactor according to claim 1, wherein the inner core portion has a higher saturation magnetic flux density than a saturation magnetic flux density of the outer core portion.

5. The reactor according to claim 1, wherein the inner core portion is a powder compact.

6. The reactor according to claim 1, wherein the case has an inner wall surface formed to correspond to an external shape of at least one of the coil and the inner core portion.

7. The reactor according to claim 1, wherein an outer peripheral surface of the coil is partly exposed from the outer core portion.

8. The reactor according to claim 1, wherein the case has a support portion that supports the coil and the inner core portion by supporting both end portions of the inner core portion protruding from the coil.

* * * * *